United States Patent [19]

Muench

[11] Patent Number: 4,484,449

[45] Date of Patent: Nov. 27, 1984

[54] LOW TEMPERATURE FAIL-SAFE CASCADE COOLING APPARATUS

[76] Inventor: Ernest Muench, 2681 Bloor St. W-4, Toronto, Ontario, Canada, M8X 1A4

[21] Appl. No.: 466,461

[22] Filed: Feb. 15, 1983

[51] Int. Cl.[3] ..... F25B 7/00

[52] U.S. Cl. ..... 62/79; 62/175; 62/231; 62/335; 318/112; 417/12

[58] Field of Search ..... 417/3, 8, 12; 318/112, 318/484, 486, 564; 62/175, 335, 231, 510, 79; 236/1 EA

[56] References Cited

U.S. PATENT DOCUMENTS

| | | | |
|---|---|---|---|
| 1,666,873 | 4/1928 | Durdin, Jr. | 417/8 |
| 1,828,696 | 10/1931 | Woodford | 417/8 X |
| 1,982,578 | 11/1934 | Durdin, Jr. | 417/8 |
| 2,707,869 | 5/1955 | Dennison | 62/175 X |
| 3,122,003 | 2/1964 | Sullivan | 62/510 X |
| 3,285,181 | 11/1966 | Howard | 417/8 |

*Primary Examiner*—William E. Tapolcai
*Attorney, Agent, or Firm*—Jones, Tullar & Cooper

[57] ABSTRACT

My invention relates to improvements in cascade cooling apparatus and to a method for maintaining a substantially safe low temperature level within an enclosure. In general, the invention is concerned with an apparatus that is designed for fail safe low temperature cascade cooling operation and specifically with preservation of biological specimen in low temperature storage. The invention incorporates a control system to continuously operate said cascade apparatus despite failure of a component therein, while maintaining a safe level of low temperature within the enclosure whose temperature is produced by said apparatus.

8 Claims, 4 Drawing Figures

LOW TEMPERATURE FAIL-SAFE CASCADE COOLING APPARATUS

BACKGROUND OF THE INVENTION

The present invention relates to cascade cooling systems capable of continuous operation despite the failure of certain components therein. The system also prolongs the life and improves the reliability of compressors used therein by operating them intermittently.

In the prior art relating to low temperature continuously operated three stage cascade cooling apparatus numerous applications can be found in storage freezers, environmental test chambers, metal treating baths, etc., where each cooling stage is comprised of a single refrigerating motor compressor. In most cases at the medium and low temperature stage cooling level, the motor compressor operation is for a short period of time. Continuous operation for periods of months and years has not been completely satisfactory with single motor compressors particularly when operated in high ambient environment and with fluorinated refrigerants as the cooling medium. It has been difficult to provide long term effective motor compressor lubrication because fluorinated refrigerants tend to displace and wash the oil film from reciprocating motor compressor components. This is due to low oil solubility and the difficulty in keeping the oil in the motor compressor. A further handicap to overcome in a conventionally designed three stage low temperature cascade cooling apparatus operated with single motor compressors for each stage is the necessary periodic termination of the cooling apparatus in order to limit friction increase in the motor compressor reciprocating components. Increased friction will lead to motor compressor seizure and electric winding burn out. A further handicap to overcome is that during failure of a single motor compressor in a three stage cascade cooling apparatus arrangement, the process of refrigerating the storage enclosure stops and rapid temperature rise occurs. Unless a back up $CO_2$ or $LN_2$ liquid injection cooling system is provided, the storage enclosure contents have to be transferred to a standby enclosure immediately to prevent their spoilage.

SUMMARY OF THE INVENTION

The present invention provides cascade cooling apparatus in which at least one stage uses a dual motor compressor arrangement controlled by a simple system. In one arrangement a First or High temperature stage is provided with a single motor compressor and a cooling medium which is compatible with lubricating oils and has been used for many years in domestic and commercial storage freezers. The First or High temperature stage single motor compressor is arranged to continuously operate in order to produce cooling for the Second or Medium stage dual motor compressor arrangement. The cooling medium of the Second or Medium stage by heat exchange is liquified to enter the throttling device connected to the storage enclosure evaporator coil of the Second or Medium stage to produce cooling. From here the refrigerating superheated gases return to the suction side of the Second or Medium stage cascade cooling arrangement. The dual motor compressors are electrically connected to a temperature responsive switch which is further connected to a magnetic switching relay. These connections alternately energize one motor-compressor and deenergize the second motor-compressor. An interval timer electrically connected to the magnetic coil of the switching relay effects the switching process of the dual motor compressor Second or Medium stage arrangement.

In a more complex embodiment of my invention I provide each stage of a three stage cascade cooling apparatus with a dual motor compressor cooling arrangement and with a simple control system. The latter includes an interval timer for the purpose of switching electromechanical relays, to which each dual motor compressor cooling stage is electrically connected in such a manner that only one motor compressor of each cooling stage can be energized at any one time while the second motor compressor must remain deenergized. The period of timing for the interval timer is set in accordance with the requirement to maintain a safe low temperature level for the storage enclosure contents, and also to insure each dual motor compressor cooling stage will oeprate at its maximum efficiency by preventing excessive temperature increase to motor compressor electric windings during high embient temperature, or during heavy loading of the storage enclosure by contents to be frozen or by too frequent opening of the storage enclosure door. A further important feature of the interval timer is to limit the enclosure temperature rise to an acceptable temperature level during failure of one motor compressor, when the entire cooling process stops for one timing interval. During the next timing interval the defective motor compressor is deenergized and the next operative motor compressor energized to provide cooling and restart the three stage cascade cooling process, thus lowering the enclosure temperature to the previous level. During the next successive timing intervals when the defective motor compressor will again inhibit the cooling process, the temperature enclosure warm up will be limited to a safe level by the timing interval length. The motor compressor failed condition can therefore be tolerated for days and weeks before remedial action need be taken to replace the defective motor compressor. During this time a safe and low temperature level in the storage enclosure will be maintained thereby protecting its contents from spoilage.

A definite timing period is set for the interval timer switching operation. This period must limit to a safe level the motor compressors electric winding temperature increase of each stage and also must keep to a minimum the friction increase of the motor compressors reciprocating components. One result of this design is that the motor compressors operate at their maximum cooling efficiency. Also and most important, the enclosure temperature rise is limited to a safe level during failure of one operative motor compressor. During failure, the interval timer switches off the defective side motor compressor arrangement and simultaneously switches on the operative parallel-connected motor compressor arrangement to provide cooling which will rapidly lower the enclosure temperature to the previous temperature level. This temperature will be maintained for a time period dependent on the interval timer timing. Since the duration of the timer period is related to the enclosure temperature rise, to ambient temperature in which the storage enclosure is located and also to the maximum allowable storage enclosure warm up permitted, failure in a motor compressor can be tolerated for an extended time. During this time, corrective action can be taken to repair the failed motor compressor. A safe temperature level for the enclosure contents will be maintained without requiring immediate attention.

The invention relates to a cascade cooling system for an enclosure, the cooling system having a first stage and a second stage, at least the second stage consisting of a pair of motor driven compressors with their coolant flow paths connected in parallel, timing means connected to control the energization of the motor driven compressors of the second stage whereby they are alternatively energized for predetermined periods of time, the capacity of one of the motor driven compressors being sufficient to maintain the enclosure below a safe temperature level when energized for the predetermined periods of time.

In its method aspect, the invention relates to a method of maintaining a safe low temperature level in an enclosure having a two stage cooling system, comprising providing at least the second stage with a pair of motor driven compressors and alternately energizing the compressors for predetermined time periods, the capacity of each compressor operating alone being sufficient to maintain the enclosure below the safe temperature level when energized for the predetermined time periods.

The full object and advantages of my invention will appear from the detailed description in the appended specifications. The novel features of the invention will be particularly pointed out in the claims.

DESCRIPTION OF PREFERRED EMBODIMENTS

Figure 3:
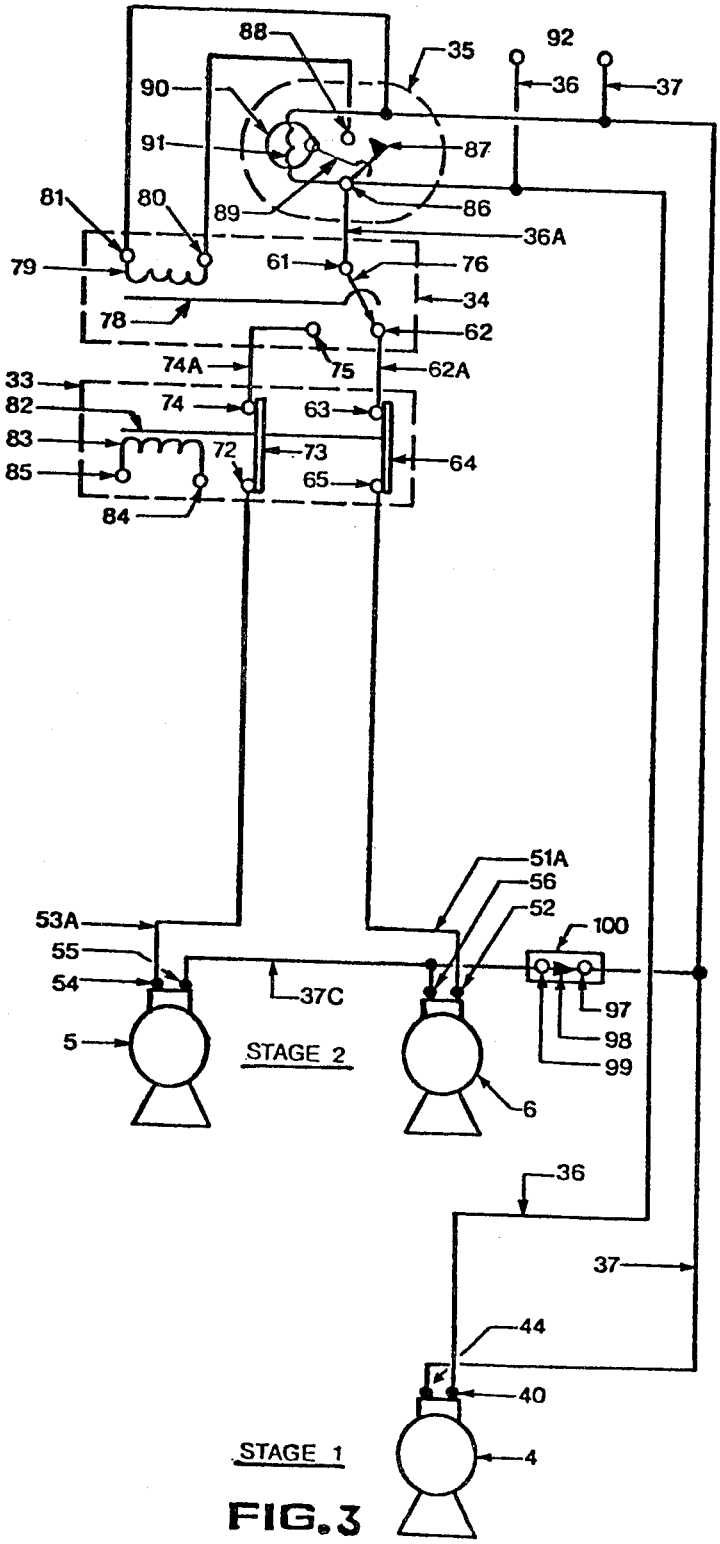
FIG. 3 is a schematic diagram of an electrical control system applied to the Medium Temperature Fail Safe Two Stage Cascade Cooling Apparatus forming part of the present invention.
Figure 4:
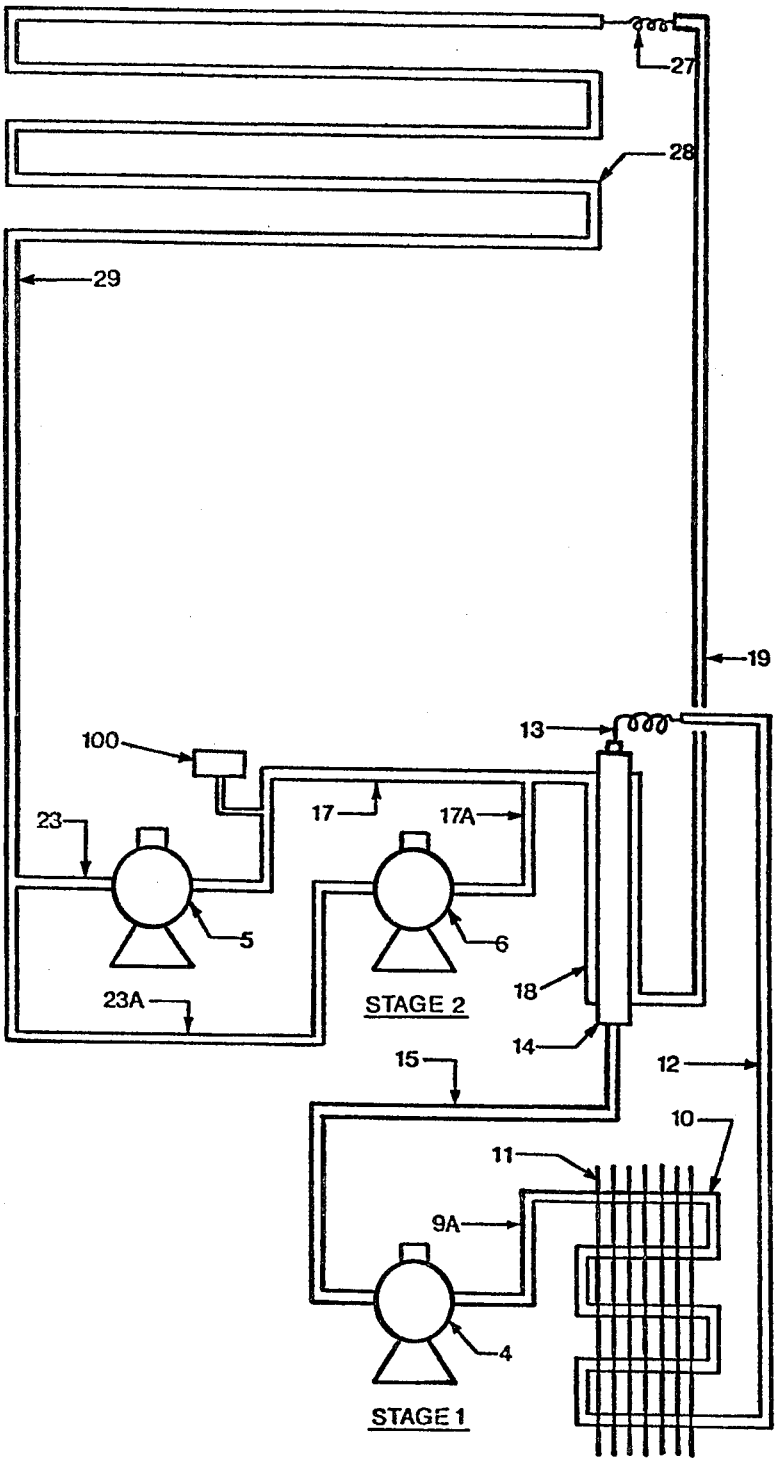
FIG. 4 is a schematic of a Two Stage dual motor compressor second stage and single motor compressor first stage cooling arrangement to which the invention is applied.

Referring now to FIGS. 3 and 4 of the drawings, one embodiment of the invention will be explained in detail.

FIG. 4

Indicated by reference numeral 4 is refrigerant motor compressor of the first cooling stage. The high pressure side of motor compressor 4 is connected to conduit 9A. Conduit 9A is further connected to air cooled condenser 10 which is provided with finned surface 11. Conduit 12 which is the extension of air cooled condenser 10 is connected to a capillary tube restrictor 13 which is connected to the inlet end of cascade condenser heat exchanger tube 14 of the first stage with its outlet connected to low pressure suction conduit 15 to enter motor compressor 4.

Indicated by reference numeral 5 and 6 are refrigerant motor compressors of the second cooling stage. The high pressure side of motor compressor 5 is connected by conduit 17 and the high pressure side of motor compressor 6 is connected by conduit 17A. Conduit 17 and 17A are further connected in parallel at which point they enter the inlet heat exchanger tube 18 of the second stage. The outlet of heat exchanger tube 18 is connected to conduit 19 which is further connected to capillary tube restrictor 27 which is connected to the inlet of the storage enclosure cooling coil evaporator 28 which connects to suction conduit 29. Conduit 29 connects into parallel low pressure conduit 23 to enter motor compressor 5 and suction conduit 23A to enter motor compressor 6.

FIG. 3

FIG. 3 schematically shows the electrical connection of the first stage motor compressor 4, the second stage motor compressor 5 and 6, magnetic switching relays 34, high pressure limit switch 100, magnetic starter 33 and interval timer 35 which control the operation of said two stage cascade cooling apparatus.

All of these instrumentalities are, or may be of standard construction. The uniqueness of the invention resides in the dual motor compressor cooling arrangement and in the means by which controlling operation is performed.

Under normal operating conditions (with the parts in position shown in FIG. 3), current is flowing from mains supply 92 through conductor 37 to terminal 97 through switchblade 98, terminal 99 of high pressure limit switch 100 to terminal 56 of motor compressor 6 and through extension conductor 37C to terminal 55 of motor compressor 5 of the second cooling stage. Current flowing in conductor 37 further enters terminal 44 of motor compressor 4 of the first cooling stage. Current flowing in conductor 36 from mains supply 92 enters terminal 86 of interval timer 35 with extension conductor 36A to enter terminal 61 through normally closed switchblade 76 to terminal 62 of magnetic switching relay 34 with extension conductor 62A to enter terminal 63 through closed switchblade 64 to terminal 65 of magnetic starter 33 with extension conductor 51A to terminal 52 of motor compressor 6 of the second cooling stage which is in operative state.

Current in conductor 36 further flows to terminal 40 of motor compressor 4 of the first cooling stage which is in operative state. Further current from terminal 86 enters magnetic coil of timing motor 91 of interval timer 35 and into conductor 37 which rotates armature 90 with pivoted arm 89 and switchblade 87 which is in open position between terminal 86 and 88. Assuming now the storage enclosure temperature level is reached, a thermostatic controller (not shown) connected to terminal 85 and 84 of magnetic coil 83 releases armature 82 connected to switchblade 73 and 64, thus breaking contacts 74, 72 and 63, 65 of magnetic starter 33. This disconnects operative motor compressor 6 of the second cooling stage for a differential temperature level rise dependent on the thermostatic controller function. Motor compressor 4 of the first cooling stage is thus in continuous operative state producing cooling for the cascade condenser heat exchanger of the second stage. In this way immediate liquid refrigerant is made available for the second stage cooling process when motor compressor 6 is again energized and contacts 63, 65 are closed by switchblade 64. Contact 74 and 72 are closed by switchblade 73 of magnetic starter 33 by a thermostatic controller (not shown), which energizes magnetic coil 83 and actuates armature 82 to perform said contact closure.

Assuming now a change to a second operative condition after interval timer 35 switches into the next timing interval, switchblade 87 closes to contact 88 to allow current to flow to terminal 80 through magnetic coil 79, then to terminal 81 of switching relay 34. This pulls armature 78 with switchblade 76 from contact 62 to contact 75 to disconnect motor compressor 6 and connect motor compressor 5. Current will then flow through extension conductor 74A to contact 74, switchblade 73, contact 72 of magnetic starter 33, through conductor 53A to terminal 54. This energizes motor compressor 5 of the second cooling stage.

Assume now a third operative condition when motor compressor 5 fails through electrical or mechanical defects. In this situation the second cooling stage becomes inoperative and therefore no heat exchange is produced for heat exchanger tube 18 of the second cooling stage. Thus pressure will rise in conduit 17 and 17A of high pressure side motor compressor 5, 6 and high pressure limit switch 100. Switchblade 98 will then move from contact 97 to interrupt current flow from contact 99 through extension conductor 37C to terminal 55 of motor compressor 5. The cooling process of the second cooling stage is thereby stopped and a temperature rise will occur in the storage enclosure for one interval timing period. During the next interval timing period, magnetic coil 79 is deenergized. This moves armature 78 with switchblade 76 to contact 62. In this way, current flow is interrupted in extension conductor 74A to terminal 54 of failed motor compressor 5 which will be deenergized. Current is then allowed to flow through extension conduit 51A to terminal 52 energizing motor compressor 6 to provide immediate cooling for heat exchanger tube 18. Pressure in conduit 17A, 17 and high pressure limit switch 100 is thus lowered to move switchblade 98 from open position to contact 97. Current can now flow from contact 99 to terminal 56, thus energizing motor compressor 6 of the second cooling stage. Immediate cooling is then produced for the storage enclosure. Temperature will be lowered to its present controlled temperature level until the next interval timing period arrives.

During following interval timing periods, failed motor compressor 5 of the second cooling stage will be energized whenever magnetic coil 79 is activated. Activation pulls armature 78 with switchblade 76 to contact 75. Current is thus allowed to flow to terminal 54 but no cooling is produced for the heat exchanger tube 18 of the second cooling stage. This will again raise pressure in conduit 17 and 17A of the high pressure side of motor compressor 5, 6 and high pressure limit switch 100. Switchblade 98 will then have to move from contact 97 to interrupt current flow to motor compressor 5, thereby stopping the cooling process of the second cooling stage and therefore again causing temperature rise in the storage enclosure for one interval timing period. While temperature rise in the storage enclosure is limited by the interval timer timing length, motor compressor failed condition can be tolerated for periods of days and weeks during which time corrective action to replace the defective motor compressor can be taken without spoilage of storage enclosure contents. This feature is not available with standard design single motor compressor two stage cascade cooling apparatus.

A highly important advantage of the invention is in the provision of a dual motor compressor arrangement for the second stage cascade cooling apparatus. The apparatus can operate continuously under unfavourable environmental condition. The interval timer switches one motor compressor on to produce maximum cooling efficiency and the second motor compressor is off. During the off times, internal heat is completely dissipated and original oil lubricating efficiency is restored. Loss of lubricating efficiency has been a handicap in the past where it has been customary to use single motor compressors leading to a high failure rate.

An embodiment of the invention using a three stage cascade cooling apparatus will now be described in conjunction with FIGS. 1 and 2.

FIG. 2

Indicated by reference numeral 3 and 4 are refrigerant motor compressors of the first cooling stage. The high pressure side of motor compressor 3 is connected by conduit 9 and the high pressure side of motor compressor 4 is connected by conduit 9A. Conduit 9 and 9A are further connected in parallel at which point they enter the inlet of air cooled condenser 10 which is provided with finned surface 11. Conduit 12 which is the extension of air cooled condenser 10 is connected to a capillary tube restrictor 13 which is connected to the inlet end of cascade condenser heat exchanger tube 14 of the first stage with its outlet connected to conduit 15, which connects into parallel-connected low pressure suction conduit 16 to enter motor compressor 3 and suction conduit 16A to enter motor compressor 4.

Indicated by reference numeral 5 and 6 are refrigerant motor compressors of the second cooling stage. The high pressure side of motor compressor 5 is connected by conduit 17 and the high pressure side of motor compressor 6 is connected by conduit 17A. Conduit 17 and 17A are further connected in parallel at which point they enter the inlet heat exchanger tube 18 of the second stage. The outlet of heat exchanger tube 18 is connected to conduit 19 which is further connected to capillary tube restrictor 20 which is connected to the inlet of cascade condenser heat exchanger tube 21 of the second stage with its outlet connected to conduit 22 which connects into parallel low pressure suction conduit 23 to enter motor compressor 5 and suction conduit 23A to enter motor compressor 6.

Indicated by reference numeral 7 and 8 are refrigerant motor compressors of the third cooling stage. The high pressure side of motor compressor 7 is connected by conduit 24 and the high pressure side of motor compressor 8 is connected by conduit 24A. Conduit 24 and 24A are further connected in parallel at which point they enter the inlet heat exchanger tube 25 of the third stage. The outlet of heat exchanger tube 25 is connected to conduit 26 which is further connected to capillary tube restrictor 27 which is connected to the inlet of the storage enclosure cooling coil evaporator 28 which connects to suction conduit 29. Conduit 29 connects into parallel low pressure conduit 30 to enter motor compressor 7 and suction 30A to enter motor compressor 8.

FIG. 1

Figure 1:
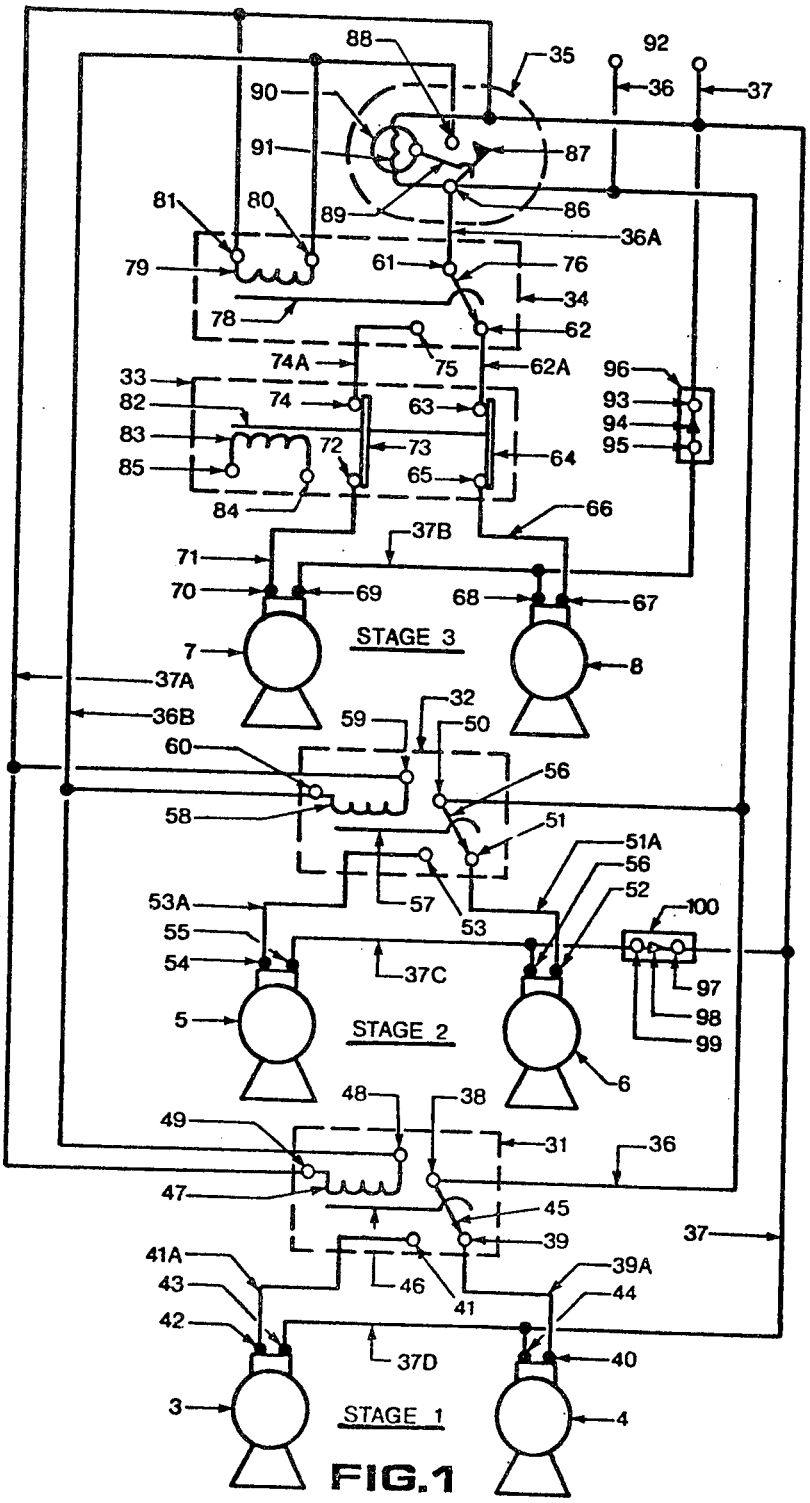
FIG. 1 is a schematic diagram of an electrical control system forming the present invention.
Figure 2:
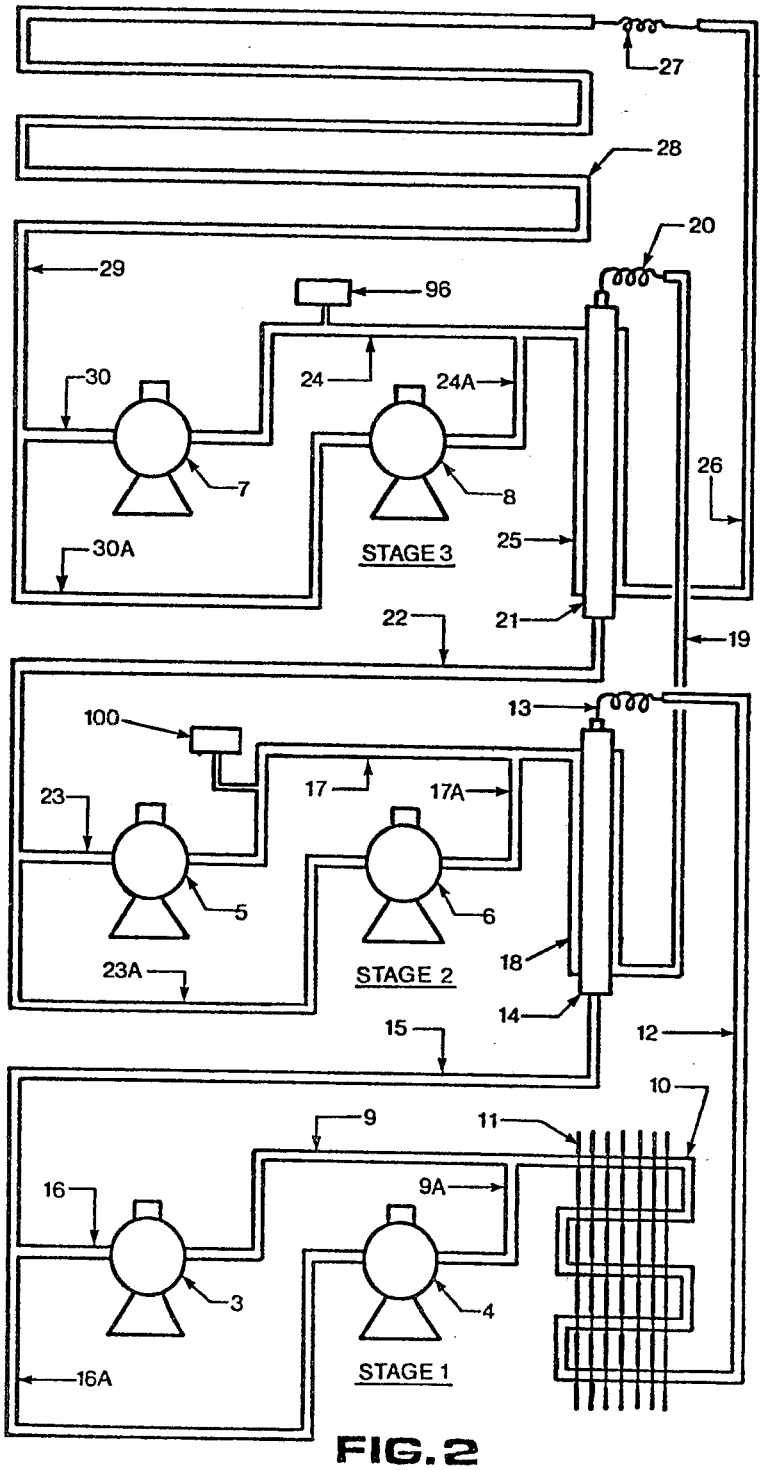
FIG. 2 is a schematic of a three stage dual motor compressor cascade cooling system to which the invention is applied.

FIG. 1 schematically shows the electrical connection of the first stage motor compressor 3 and 4, the second stage motor compressor 5 and 6, the third stage motor compressor 7 and 8, magnetic switching relays 31, 32, 34, high pressure limited switch 100 and 96, magnetic starter 33 and interval timer 35 which control the operation of said three stage cascade cooling apparatus.

All of these instrumentalities are, or may be of standard construction. The uniqueness of the invention resides in the dual motor compressor cooling arrangement and in the means by which controlling operation is performed.

Under normal operating conditions (with the parts in position shown in FIG. 1), current is flowing from mains supply 92 through conductor 37 to terminal 93 of high pressure limit switch 96, through switchblade 94 in closed position to terminal 95 and to terminal 68 of motor compressor 8 and through extension conductor 37B to terminal 69 of motor compressor 7 of the third cooling stage. Current flowing on conductor 37 further enters terminal 97 through switchblade 98, terminal 99 of high pressure limit switch 100 to terminal 56 of motor compressor 6 and through extension conductor 37C to terminal 55 of motor compressor 5 of the second cooling stage. Current flowing in conductor 37 further enters terminal 44 of motor compressor 4 and through extension conductor 37D to terminal 43 of motor compressor 3 of the first cooling stage. Current flowing in conductor 36 from mains supply 92 enters terminal 86 of interval timer 35 with extension conductor 36A to enter terminal 61 through normally closed switchblade 76 to terminal 62 of magnetic switching relay 34 with extension conductor 62A to enter terminal 63 through closed switchblade 64 to terminal 65 of magnetic starter 33 with extension conductor 66 to terminal 67 of motor compressor 8 of the third cooling stage which is in operative state.

Current in conductor 36 further flows to terminal 50 through closed switchblade 56 to terminal 51 of magnetic switching relay 32 with extension conductor 51A to terminal 52 of motor compressor 6 of the second cooling stage which is in operative state. Current in conductor 36 further flows to terminal 38 through close switchblade 45 to terminal 39 of magnetic switching relay 31 with extension conductor 39A to enter terminal 40 of motor compressor 4 of the first cooling stage which is in operative state. Further current from terminal 86 enters magnetic coil of timing motor 91 of interval timer 35 and into conductor 37 which rotates armature 90 with pivoted arm 89 and switchblade 87 which is in open position between terminals 86 and 88. Assuming now the storage enclosure temperature level is reached, a thermostatic controller (not shown) connected to terminal 85 and 84 of magnetic coil 83 releases armature 82 connected to switchblade 73 and 64, thus breaking contacts 74, 72 and 63, 65 of magnetic starter 33. This disconnects operative motor compressor 8 of the third cooling stage for a differential temperature level rise dependent on the thermostatic controller function. Motor compressor 6 of the second cooling stage and motor compressor 4 of the first cooling stage are thus in continuous operative state producing cooling for the cascade condenser heat exchanger of the second and third stages. In this way immediate liquid refrigerant is made available for the third stage cooling process when motor compressor 8 is again energized and contacts 63, 65 are closed by switchblade 64. Contacts 74 and 72 are closed by switchblade 73 of magnetic starter 33 by a thermostatic controller (not shown), which energizes magnetic coil 83 and actuates armature 82 to perform said contact closure.

Assuming now a change to a second operative condition after interval timer 35 switches into the next timing interval, switchblade 87 closes to contact 88 to allow current to flow to terminal 80 through magnetic coil 79, then to terminal 81 of switching relay 34. This pulls armature 78 with switchblade 76 from contact 62 to contact 75 to disconnect motor compressor 8 and connect motor compressor 7. Current will then flow through extension conductor 74A to contact 74, switchblade 73, contact 72 of magnetic starter 33, through conductor 71 to terminal 70. This energizes motor compressor 7 of the third cooling stage. Further, current in conductor 36B enters terminal 60 of magnetic coil 58, terminal 59 and conductor 37A. This energizes magnetic switching relay 32, pulling armature 57 with switchblade 56 from contact 51 to contact 53. This current is allowed to flow through conductor 53A to terminal 54 to energize motor compressor 5 and disconnect motor compressor 6 of the second cooling stage. Further, current in conductor 36B enters terminal 48 of magnetic coil 47, terminal 49 and conductor 37A to energize magnetic switching relay 31, pulling armature 46 with switchblade 45 from contact 39 to contact 41 to allow current flow through conductor 41A. This energizes motor compressor 3 and dissconnects motor compressor 4 of the first cooling stage.

Assume now a third operative condition when motor compressor 5 fails through electrical or mechanical defects. In this situation the second cooling stage becomes inoperative and therefore no heat exchange is produced for heat exchanger tube 25 of the third cooling stage. Thus pressure will rise in conduit 24 and 24A of high pressure side motor compressor 7, 8 and high pressure limit switch 96. Switchblade 94 will then move from contact 93 to interrupt current flow from contact 95 through extension conductor 37B to terminal 69 of motor compressor 7. The cooling process of the third cooling stage is thereby stopped and a temperature rise will occur in the storage enclosure for one interval timing period. During the next interval timing period, magnetic coil 58 is deenergized. This moves armature 57 with switchblade 56 to contact 51. In this way, current flow is interrupted in extension conductor 53A to terminal 54 of failed motor compressor 5 which will be deenergized. Current is then allowed to flow through extension conduit 51A to terminal 52 energizing motor compressor 6 to provide immediate cooling for heat exchanger tube 25. Pressure in conduit 24A, 24 and high pressure limit switch 96 is thus lowered to move switchblade 94 from open position to contact 93. Current can now flow from contact 95 to terminal 68, thus energizing motor compressor 8 of the third cooling stage. Immediate cooling is then produced for the storage enclosure. Temperature will be lowered to its present controlled temperature level until the next interval timing period arrives.

During following interval timing periods, failed motor compressor 5 of the second cooling stage will be energized whenever magnetic coil 58 is activated. Activation pulls armature 57 with switchblade 56 to contact 53. Current is thus allowed to flow to terminal 54 but no cooling is produced for the heat exchanger tube 25 of the third cooling stage. This will again raise pressure in conduit 24 and 24A of the high pressure side of motor compressor 7, 8 and high pressure limit switch 96. Switchblade 94 will then have to move from contact 93 to interrupt current flow to motor compressor 7, thereby stopping the cooling process of the third cooling stage and therefore again causing temperature rise in the storage enclosure for one interval timing period. While temperature rise in the storage enclosure is limited by the interval timer timing length, motor compressor failed condition can be tolerated for periods of days and weeks during which time corrective action to replace the defective motor compressor can be taken without spoilage of storage enclosure contents. This feature is not available with standard design single motor compressor three stage cascade cooling apparatus.

A highly important advantage of the invention is in the provision of a dual motor compressor arrangement for each stage of a three stage cascade cooling apparatus. The apparatus can operate continuously under unfavorable environmental conditions. The interval timer switches one motor compressor on to produce maximum cooling efficiency and the second motor compressor is off. During the off times, internal heat is completely dissipated and original oil lubricating efficiency is restored. Loss of lubricating efficiency has been a handicap in the past where it has been customary to use single motor compressors. Consequently a high rate of failure was evident for the purpose set forth.

As the invention is subject to minor changes that are within the skill of ordinary mechanics, the invention is not limited to the extent of the disclosure, but is only limited to the extent of the appended claim.

I claim:

1. A cascade cooling system for an enclosure, the cooling system having a first stage and a second stage, at least the second stage consisting of a pair of motor driven compressors with their coolant flow paths connected in parallel, a timer connected to control the energization of the motor driven compressors of the second stage, and switching means responsive to said timer to energize only one compressor at any time, an energized compressor being limited to operation for an interval not exceeding a predetermined duration, the capacity of one of said motor driven compressors being sufficient to maintain said enclosure below a safe temperature level when energized for intervals of said predetermined duration.

2. The system of claim 1 wherein said timer is an interval timer and said switching means is a switching relay controlled by said timer and connected to said motor driven compressors.

3. A method of maintaining a safe low temperature level in an enclosure having a two stage cooling system, comprising providing at least the second stage with a pair of thermostatically controlled motor driven compressors and alternately energizing only one of the compressors at any time via its thermostatic control for intervals not exceeding a predetermined duration, the capacity of each compressor operating alone being sufficient to maintain said enclosure below said safe temperature level when energized for intervals of said predetermined duration.

4. Apparatus for maintaining a substantially safe low temperature level within an enclosed space, comprising a mechanical refrigerating three stage cascade cooling system including a first stage dual motor compressor arrangement having first and second motor compressors with their high pressure sides and normally low pressure sides connected in parallel and disposed in heat exchange relationship with a cascade condenser heat exchanger of the second cooling stage, a control device operatively associated with said first and second motor compressors and adapted to energize one motor compressor and simultaneously de-energize the other motor compressor, an interval timer operatively associated with said control device to limit the energization to a predetermined duration, and a thermostatic switch interposed between said control device and said motor compressors.

5. Apparatus for maintaining a substantially safe low temperature level within an enclosed space, comprising a mechanical refrigerating three stage cascade cooling system including a first stage dual motor compressor arrangement having first and second motor compressors with their high pressure sides connected in parallel and disposed in heat exchange relationship with a cascade condenser heat exchanger of the second cooling stage, a control device operatively associated with said first and second motor compressors and adapted to energize one motor compressor and simultaneously de-energize the other motor compressor, an interval timer operatively associated with said control device to limit the energization to a predetermined duration, a thermostatic switch interposed between said control device and said motor compressors, said second stage dual motor compressor arrangement having third and fourth motor compressors with their high pressure sides and normally low pressure sides connected in parallel and disposed in heat exchange relationship with a cascade condenser heat exchanger of the third cooling stage, a control device operatively associated with said third and fourth motor compressors and adapted to energize one motor compressor and simultaneously de-energize the other motor compressor and an interval timer operatively associated with said control device to limit the energization to a predetermined duration.

6. Apparatus for maintaining a substantially safe level of low temperature within an enclosed space, comprising a mechanical refrigerating three stage cascade cooling system including a first stage dual motor compressor arrangement with high pressure side and normally low pressure side connected in parallel and disposed in heat exchange relationship with cascade condenser heat exchanger of the second cooling stage, conduit means connecting in parallel said high and normally low pressure sides, two motor compressors disposed in said system continuously and alternately operated, a control device operatively associated with said two motor compressors and adapted to alternately energize one motor compressor and simultaneously deenergize the second motor compressor, an interval timing device operatively associated with said control device to perform the aforesaid function, a first circuit including both motor compressors and said control device, and a second circuit including said control and interval timing device, a second stage dual motor compressor arrangement with high pressure side and normally low pressure side connected in parallel and disposed in heat exchange relationship with cascade condenser heat exchanger of the third cooling stage, conduit means connecting in parallel said high and normally low pressure sides, two motor compressors disposed in said system continuously and alternately operated, a control device operatively associated with said two motor compressors and adapted to alternately energize one motor compressor and simultaneously de-energize the second motor compressor, an interval timing device operatively associated with said control device to perform the aforesaid function, a first circuit including both motor compressors and said control device, and a second circuit including said control and interval timing device, a third stage dual motor compressor arrangement with high pressure side and normally low pressure side connected in parallel and disposed in heat exchange relationship with evaporator of said enclosed space, conduit means connecting in parallel said high and normally low pressure sides, two motor compressors disposed in said system continuously and alternately operated, a temperature responsive switch operatively associated with said two motor compressors and adapted to regulate temperature level of said enclosed space, a control device operatively associated with said temperature responsive switch and adapted to alternately energize one motor compressor and simultaneously de-energize the second motor compressor, an interval timing device operatively associated with said control device to perform the aforesaid function, a first circuit including both motor compressors and said temperature responsive switch, a second circuit including said temperature responsive switch and said control device, and a third circuit including said control and interval timing device.

7. Apparatus for maintaining a substantially safe low temperature level within an enclosed space, comprising a mechanical refrigerating three stage cascade cooling system including a first stage dual motor compressor arrangement with high pressure side and normally low pressure side connected in parallel and disposed in heat exchange relationship with cascade condenser heat exchanger of the second cooling stage, conduit means connecting in parallel said high and normally low pressure sides, two motor compressors disposed in said system continuously and alternately operated, a control device operatively associated with said two motor compressors and adapted to alternately energize one motor compressor and simultaneously de-energize the second motor compressor, an interval timing device operatively associated with said control device to perform the aforesaid function, a first circuit including both motor compressors and said control device, and a second circuit including said control and interval timing device, a second stage dual motor compressor arrangement with high pressure side and normally low pressure side connected in parallel and disposed in heat exchange relationship with cascade condenser heat-exchanger of the third cooling stage, conduit means connecting in parallel said high and normally low pressure sides, two motor compressors disposed in said system continuously and altermately operated, a control device operatively associated with said two motor compressors and adapted to alternately energize one motor compressor and simultaneously de-energize the second motor compressor, an interval timing device operatively associated with said control device to perform the aforesaid function, a high pressure limit device, conduit means connecting said high pressure limit device to high pressure conduit side, operatively associated with said two motor compressors and adapted to energize said motor compressors on change in pressure in said conduit, a first conduit including both motor compressors and said control device, a second circuit including said control and interval timing device, a fourth circuit including high pressure limit device and said motor compressors, a third stage dual motor compressor arrangement with high pressure side and normally low pressure side connected in parallel and disposed in heat exchange relationship with evaporator of said enclosed space, conduit means connecting in parallel said high and normally low pressure sides, two motor compressors disposed in said system continuously and alternately operated, a temperature responsive switch operatively associated with said two motor compressors and adapted to regulate the temperature level of said enclosed space, a control device operatively associated with said two motor compressors and adapted to alternately energize one motor compressor and simultaneously de-energize the second motor compressor, an interval timing device operatively associated with said control device to perform the aforesaid function, a high pressure limit device, conduit means connecting said high pressure limit device to high pressure conduit side, operatively associated with said two motor compressors and adapted to energize said motor compressors on change in pressure in said conduit, a first circuit including both motor compressors and said temperature responsive switch, a second circuit including said temperature responsive switch and said control device, a third circuit including said control device and said interval timing device, and a fourth circuit including high pressure limit device and said motor compressors.

8. In a three stage cascade cooling apparatus fail safe control system, comprising a two-position magnetic switching relay and a circuit connected to a dual motor compressor arrangement of the first stage, a two-position magnetic switching relay and a circuit connected to a dual motor compressor arrangement of the second stage, a two-position magnetic switching relay and a circuit connected to a temperature responsive switch, said temperature responsive switch and circuit connected to a dual motor compressor arrangement of the third stage, an interval timer with circuit that limits temperature rise within an enclosure to a safe level during motor compressor failure, connected in parallel to said two-position magnetic switching relays of each stage to alternately energize the first set three motor compressors and simultaneously de-energize the second set three motor compressors of said dual motor compressor arrangements.

* * * * *